US010799734B2

(12) United States Patent
Gardner et al.

(10) Patent No.: US 10,799,734 B2
(45) Date of Patent: Oct. 13, 2020

(54) FIRE SUPPRESSION SYSTEM FOR SUB-FLOOR SPACE

(71) Applicant: Amazon Technologies, Inc., Reno, NV (US)

(72) Inventors: Brock Robert Gardner, Seattle, WA (US); Michael Phillip Czamara, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 1140 days.

(21) Appl. No.: 13/779,411

(22) Filed: Feb. 27, 2013

(65) Prior Publication Data

US 2014/0238705 A1 Aug. 28, 2014

(51) Int. Cl.

| | |
|---|---|
| ***A62C 3/16*** | (2006.01) |
| ***A62C 35/02*** | (2006.01) |
| ***A62C 37/00*** | (2006.01) |

(52) U.S. Cl.

CPC ..... *A62C 3/16* (2013.01); *A62C 35/02* (2013.01); *A62C 37/00* (2013.01)

(58) Field of Classification Search

CPC .. A62C 3/16; A62C 7/04; A62C 35/00; A62C 35/02; A62C 35/10; A62C 37/00; A62C 3/00; A62C 13/006; H05K 7/20745; H05K 7/20836; H05K 7/20736; H05K 7/1495; F24F 2221/40

See application file for complete search history.

(56) References Cited

U.S. PATENT DOCUMENTS

| | | | | |
|---|---|---|---|---|
| 5,653,070 | A | 8/1997 | Seguin | |
| 8,240,490 | B2 | 8/2012 | Malekmadani | |
| 8,266,921 | B2 | 9/2012 | Tashiro | |
| 2004/0244310 | A1 | 12/2004 | Blumberg | |
| 2005/0139365 | A1* | 6/2005 | Richardson | A62C 5/006 169/43 |
| 2008/0026688 | A1* | 1/2008 | Musick | B08B 1/00 454/187 |
| 2009/0000243 | A1 | 1/2009 | Blumberg | |
| 2009/0168345 | A1* | 7/2009 | Martini | F24F 11/0001 361/691 |
| 2010/0154687 | A1 | 6/2010 | Blumberg | |
| 2010/0170684 | A1* | 7/2010 | Richardson | A62C 35/02 169/46 |

(Continued)

FOREIGN PATENT DOCUMENTS

| | | | | |
|---|---|---|---|---|
| JP | 07044002 | | 10/1995 | |
| JP | 08066487 | A * | 3/1996 | A62C 3/16 |

OTHER PUBLICATIONS

International Search Report and Written Opinion from PCT/US2014/019084, dated Jun. 17, 2014, Amazon Technologies, Inc., pp. 1-14.

(Continued)

*Primary Examiner* — Alex M Valvis

(74) *Attorney, Agent, or Firm* — Robert C. Kowert; Kowert, Hood, Munyon, Rankin & Goetzel, P.C.

(57) ABSTRACT

A system includes a raised floor, a sub-floor space below the raised floor, electrical components in the sub-floor space, and a fire suppression device coupled to the raised floor. The fire suppression device dispenses fire suppression material the electrical components in the sub-floor space.

23 Claims, 7 Drawing Sheets

(56) References Cited

U.S. PATENT DOCUMENTS

| | | | | |
|---|---|---|---|---|
| 2011/0105010 | A1* | 5/2011 | Day | H05K 7/20745 454/184 |
| 2011/0222800 | A1 | 9/2011 | Hubbard et al. | |
| 2012/0031633 | A1 | 2/2012 | Su et al. | |
| 2012/0073840 | A1* | 3/2012 | Prieur | A62C 2/10 169/46 |
| 2012/0305356 | A1 | 12/2012 | Sato | |
| 2013/0025888 | A1* | 1/2013 | Eckholm | A62C 3/16 169/46 |
| 2013/0098638 | A1* | 4/2013 | Dunster | A62C 13/64 169/9 |

OTHER PUBLICATIONS

U.S. Appl. No. 13/625,519, filed Sep. 24, 2012, Brock Robert Gardner.

U.S. Appl. No. 13/625,514, filed Sep. 24, 2012, Michael P. Czamara et al.

U.S. Appl. No. 13/682,641, filed Sep. 20, 2012, John William Eichelberg.

* cited by examiner

FIRE SUPPRESSION SYSTEM FOR SUB-FLOOR SPACE

BACKGROUND

Organizations such as on-line retailers, Internet service providers, search providers, financial institutions, universities, and other computing-intensive organizations often conduct computer operations from large scale computing facilities. Such computing facilities house and accommodate a large amount of server, network, and computer equipment to process, store, and exchange data as needed to carry out an organization's operations. Typically, a computer room of a computing facility includes many server racks. Each server rack, in turn, includes many servers and associated computer equipment.

Because a computing facility may contain a large number of servers, a large amount of electrical power may be required to operate the facility. In addition, the electrical power is distributed to a large number of locations spread throughout the computer room (e.g., many racks spaced from one another, and many servers in each rack). Usually, a facility receives a power feed at a relatively high voltage. This power feed is stepped down to a lower voltage (e.g., 208 V). A network of cabling, bus bars, power connectors, and power distribution units, is used to deliver the power at the lower voltage to numerous specific components in the facility.

Some data centers include sprinkler systems to contain damage from fire in a computing room. In many data centers, the sprinkler system for a computing room includes piping and sprinkler heads that are located in, or suspended from, the ceiling of the computing room. Such sprinkler systems may not reach all of the sources of a fire in a data center. In some cases, these sprinkler systems distribute water beyond the area in which a fire is located. In such cases, some of the equipment lost in the event may be due to the water applied to areas beyond the location of the fire, rather than any fire itself.

Figure 1:
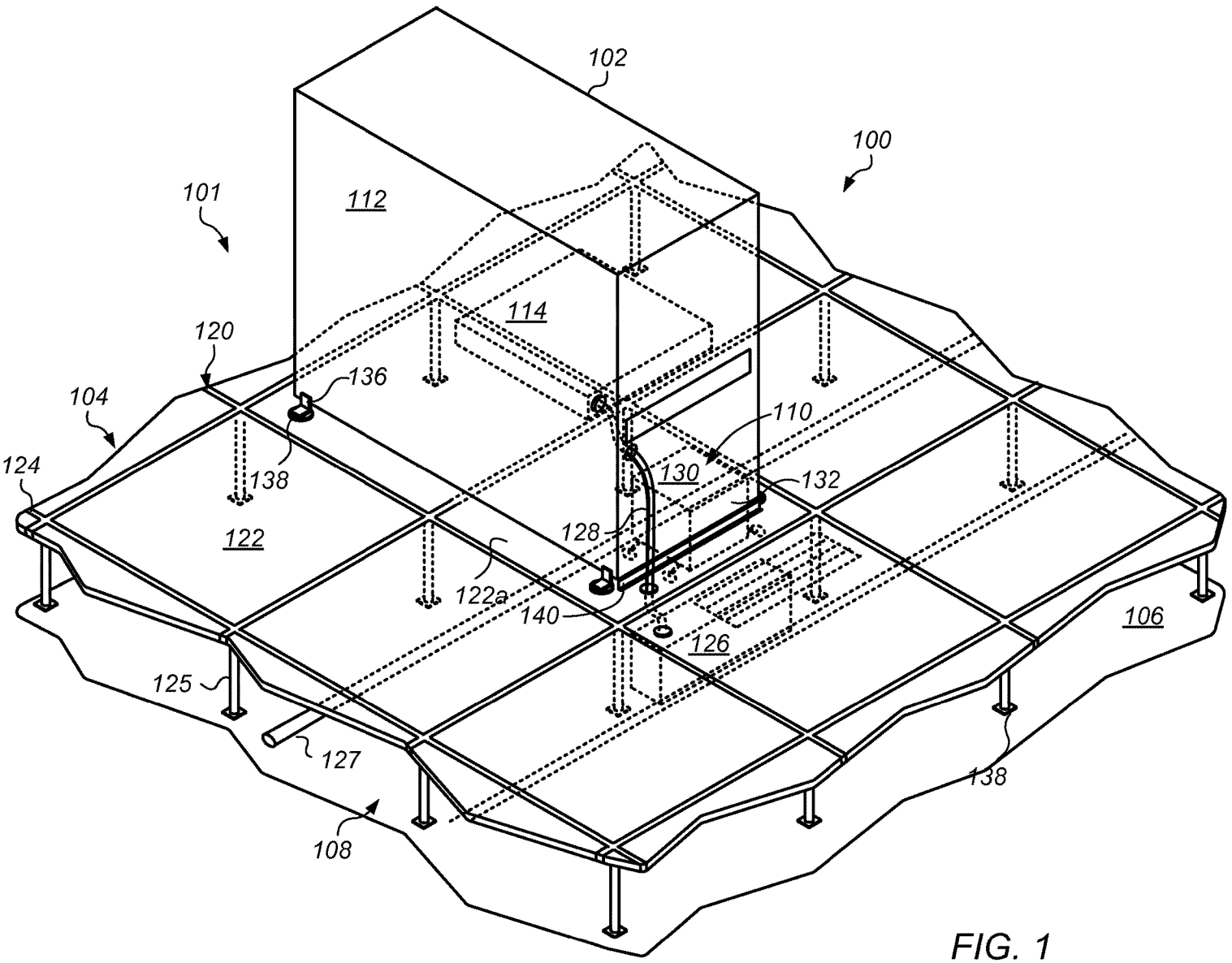
FIG. 1 illustrates one embodiment of a data center with a fire suppression device mounted on a raised floor of the data center.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION OF EMBODIMENTS

Systems and methods for protecting electrical systems operating in a data center, from environmental conditions are disclosed. According to one embodiment, a data center includes a raised floor, one or more rack computing systems, a sub-floor space below the raised floor, one or more data center infrastructure components in the sub-floor space, and one or more fire suppression devices. The raised floor includes one or more frame members and a plurality of tiles coupled to the frame members. The one or more rack computing systems coupled to the tiles. The data center infrastructure components supply electrical power or cooling air to computing devices in the rack computing systems. The one or more fire suppression devices are mounted to the tiles. The one or more fire suppression devices dispense fire suppression material to the data center infrastructure components.

According to one embodiment, a system includes a raised floor, a sub-floor space below the raised floor, electrical components in the sub-floor space, and a fire suppression device coupled to the raised floor. The fire suppression device dispenses fire suppression material toward the electrical components in the sub-floor space.

According to one embodiment, a fire suppression system includes a tile a fire suppression device coupled to the tile. The tile mounts in or on one or more frame members of a raised floor. The fire suppression device dispenses fire suppression material into space under the tile when the tile is mounted in or on the frame members.

According to one embodiment, a method of suppressing a fire includes coupling a reservoir of fire suppression material to a raised floor. In response to a fire condition, fire suppression material is dispensed into a sub-floor space below the raised floor.

As used herein, an "aisle" means a space next to one or more racks.

As used herein, a "cable" includes any cable, conduit, or line that carries one or more conductors and that is flexible over at least a portion of its length. A cable may include a connector portion, such as a plug, at one or more of its ends.

As used herein, "computing" includes any operations that can be performed by a computer, such as computation, data storage, data retrieval, or communications.

As used herein, "computing device" includes any of various devices in which computing operations can be carried out, such as computer systems or components thereof. One example of a computing device is a rack-mounted server. As used herein, the term computing device is not limited to just those integrated circuits referred to in the art as a computer, but broadly refers to a processor, a server, a microcontroller, a microcomputer, a programmable logic controller (PLC), an application specific integrated circuit, and other programmable circuits, and these terms are used interchangeably herein. Some examples of computing devices include e-commerce servers, network devices, telecommunications equipment, medical equipment, electrical power management and control devices, and professional audio equipment (digital, analog, or combinations thereof). In various embodiments, memory may include, but is not limited to, a computer-readable medium, such as a random access memory (RAM). Alternatively, a compact disc-read only memory (CD-ROM), a magneto-optical disk (MOD), and/or a digital versatile disc (DVD) may also be used. Also, additional input channels may include computer peripherals associated with an operator interface such as a mouse and a keyboard. Alternatively, other computer peripherals may also be used that may include, for example, a scanner. Furthermore, in the some embodiments, additional output channels may include an operator interface monitor and/or a printer.

As used herein, "damping" includes any effect that tends to cause a reduction in amplitude of an oscillation. Damping may include viscous damping, coulomb damping, dry friction damping, interfacial damping, and eddy current damping. Examples of dampers include piston-cylinder viscous dampers, rubber bushings, friction dampers, and magneto-heological ("MR") dampers.

As used herein, "data center" includes any facility or portion of a facility in which computer operations are carried out. A data center may include servers dedicated to specific functions or serving multiple functions. Examples of computer operations include information processing, communications, simulations, and operational control.

As used herein, "data center infrastructure" means systems, components, or elements of a system that provide resources for computing devices, such as electrical power, data exchange capability with external systems, air, heat removal, and environmental control (for example, humidity control, particulate control). Examples of data center infrastructure components include power distribution units, automatic transfer switches, generators, UPSs, blowers, fans, CRACs, control units, fiber optic cables, network switches, alarm sensors, busways, power transmission lines, junction boxes, cables, connector plugs, tubing, and pipes.

As used herein, a "frame" means a group of members that can support one or more tiles. A frame may include a grid, rails, beams, scaffolding, rods, or bars. Members of a frame may be straight, curved, or combinations thereof.

As used herein, to "mitigate" means to reduce the severity of, or risk of damage from, something, such as a load, phenomenon, or event.

As used herein, "rack computing systems" means a computing system that includes one or more computing devices mounted in a rack.

As used herein, "room" means a room or a space of a building. As used herein, "computing room" means a room of a building in which computing devices, such as rack-mounted servers, can be operated.

As used herein, "seismic activity" means an event or series of events that result in release of energy from the Earth. The release of energy may be in the form of seismic waves.

As used herein, a "seismic load" is a load on a structure caused by acceleration induced on its mass by seismic activity, such as an earthquake, tremor, or temblor.

As used herein, a "shock mount device" includes any device, element, or combination thereof, that connects two or more parts elastically. A shock mount device may include, for example, one or more wire springs. In certain embodiments, a shock mount device includes damping elements. A shock mount device may or may not bear the weight of the parts that it connects. For example, a shock mount device may be connected across two plates arranged side-by-side that are each supported by other elements or devices, such as blocks or bearings.

As used herein, a "space" means a space, area or volume.

As used herein, a "spring device" means an object that is least partially made of an elastic material and that stores mechanical energy when it is altered from its free condition by a force. A spring device may be a single piece of material or an assembly of two or more pieces of materials. Examples of spring devices include coil springs, lead rubber bearings, helical springs, leaf springs, gas springs, Belleville washers, and rubber bands.

As used herein, a "tile" means a piece of material that can be used in to form or cover a floor, wall, or ceiling of a room. Examples of a tile include a plate, slab, or sheet. A tile may be made of made of any material. Examples of materials for a tile include metal, plastic, composite, gypsum, ceramic, stone, fiberglass, or combinations thereof. A tile may have any suitable shape. Examples of shapes for a tile include square, rectangular, hexagonal, or irregular.

In some embodiments, a data center has rack computing systems on a raised floor with infrastructure components (for example, electrical power system or cooling components) in a sub-floor space below the raised floor. A fire suppression device is mounted on a tile of the raised floor. The fire suppression device can dispense fire suppression material on the data center infrastructure components in the sub-floor space.

FIG. 1 illustrates one embodiment of a data center with a fire suppression device mounted on a raised floor of the data center. Data center 100 includes computing room 101, rack computing system 102, raised floor 104, and base floor 106. Sub-floor space 108 is formed between raised floor 104 and base floor 106. Fire suppression device 110 is coupled under raised floor 104 in sub-floor space 108.

Rack computing system 102 may be deployed in computing room 101 of data center 100. Rack computing system 102 includes rack 112 and computing devices 114. Computing devices 114 may be operated to perform computing operations in the data center. In some embodiments, rack 112 is mounted on casters.

Raised floor 104 includes grid 120 and tiles 122. Grid 120 includes frame members 124. Frame members 124 may be supported on columns 125. Tiles 122 are installed in openings in grid 120. Pipes 127, busways, and other infrastructure components may run beneath tiles 122 in sub-floor space 108.

Data center 100 includes data center infrastructure component 126. In some embodiments, data center infrastructure component 126 is an electrical power system that supplies electrical power to computing devices 114 by way of power cable 128. Data center infrastructure component 126 rests on base floor 106.

Fire suppression device 110 includes reservoir 130 and dispensing devices 132. Fire suppression device 110 is attached on the underside of tile 122*a*. Fire suppression device 110 may dispense a fire suppression material in response to a fire condition in sub-floor space 108. Dispensing devices 132 may dispense fire suppression material on data center infrastructure component 126 in response to a fire condition in or around data center infrastructure component 126.

Although fire suppression device 110 is described above as protecting an electrical power supply component for illustrative purposes, a fire suppression device may in various embodiments protect other types of electrical and nonelectrical components and systems in a sub-floor space. Examples of components and systems that may be protected by a fire suppression device in a sub-floor space include blowers, computer room air conditioning (CRAC) units, fiber optic cables, fluid pipes, connector plugs, busways, air filter systems, or computer networking components.

For illustrative purposes, only one rack computing system and one infrastructure component is shown in FIG. 1. A data center may, however, include any number of racks and any number of data center infrastructure supply components, such as a UPSs and power distribution units. In some embodiments, rack computing systems are arranged in one or more rows in a computing room. In addition, fire suppression devices may be mounted to subfloor in other types of buildings. Fire suppression devices may protect any of various infrastructure components in a building, including, electrical components, fiber optic components, cooling system components, or structural components.

Data center 100 may include an air handling system that moves air through computing room 101 and rack computing system 102. In some embodiments, sub-floor space 108 serves as a cooling air plenum. An air handling system may increase air pressure in sub-floor space 108 such that air flows through floor vents into an aisle in computing room 101, as indicated by the arrows. Air in the aisle may pass through rack 112 and computing devices 114 from front to back of rack computing system 102.

Rack 112 may be secured to raised floor 104 by way of anchor brackets 136 and shock mount devices 138. Shock mount devices 138 are provided between anchor brackets 136 and raised floor 104. Anchoring rack 112 on a floor may provide additional stabilize rack computing systems 102. Nevertheless, anchor brackets 136 may, in some embodiments, be omitted, and racks 112 may rest on the floor without being attached.

Although in the embodiment shown in FIG. 1, rack computing system 102 is mounted by way of spring devices, a rack computing systems may in some embodiments be mounted in other ways. In some embodiments, a rack enclosure is mounted directly to a tile by way of brackets, for example. In certain embodiments, a rack includes casters that allow the rack enclosure to be rolled from one location to another on a floor.

Air blocking device 140 is attached to tile 122*a*. Air blocking device 140 may inhibit air from flowing under the enclosure of rack 112 and bypassing computing devices 114.

Figure 2:
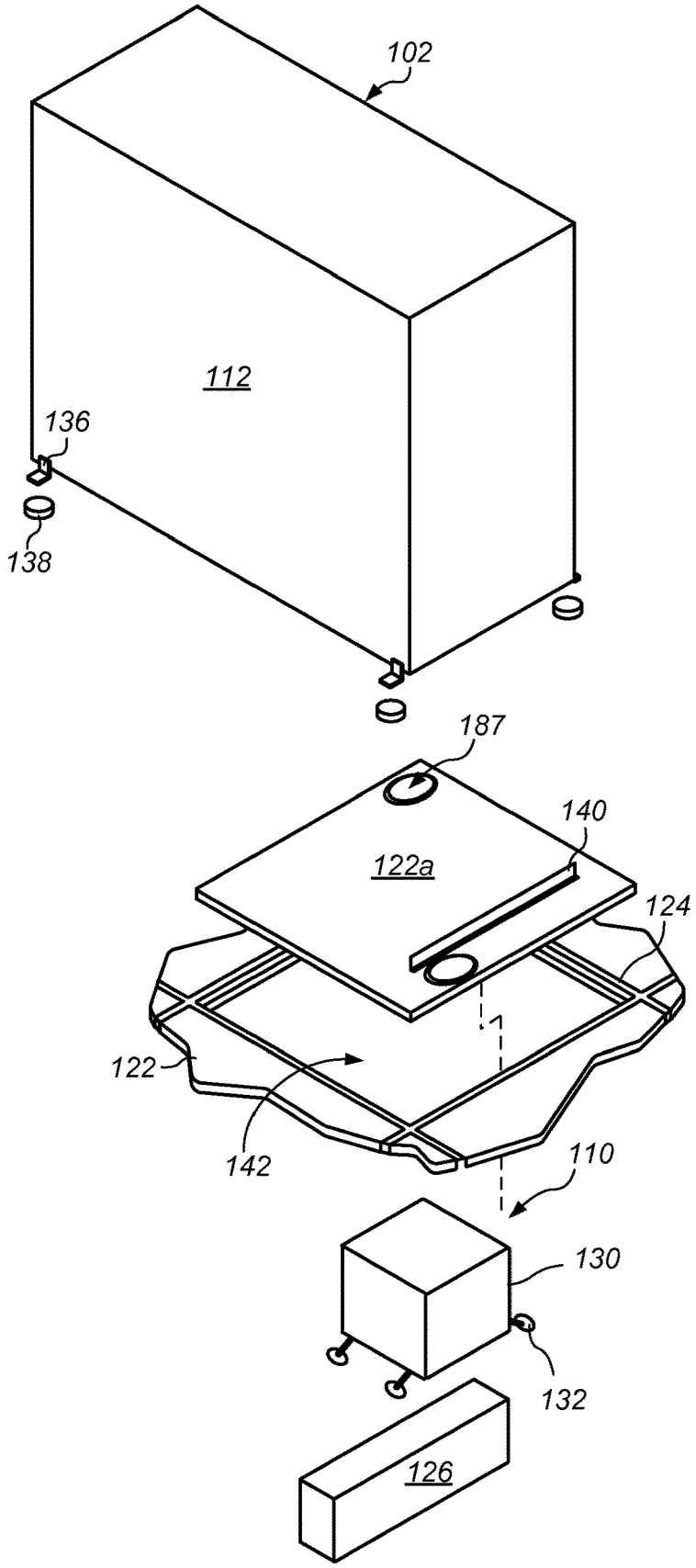
FIG. 2 is a partially exploded view of one embodiment of a data center with a fire suppression device mounted on a raised floor of the data center.

FIG. 2 is an exploded view of one embodiment of a data center with a fire suppression device mounted on a raised floor of the data center. Tile 122*a* may be installed in opening 142 formed by frame members 124. In some embodiments, frame members 124 include a support lip around the perimeter of opening 142. The support lip may support tile 122*a* in opening 142.

Fire suppression device 110 may be attached to tile 122*a*. In some embodiments, fire suppression device 110 is bolted to tile 122*a* by way of holes in tile 122*a*. In some embodiments, holes are pre-drilled or pre-formed in a tile (for example, prior to being shipped to the data center). In other embodiments, holes for a fire suppression device are drilled on-site at the data center (for example, at the time the tile and fire suppression device are installed in the raised floor).

Air blocking device 140 is attached to tile 122*a*. Air blocking device may include a solid plate. In the embodiment shown in FIG. 2, air blocking device 140 extends vertically from tile 122*a*. An air blocking device may, however, be at any angle relative to the upper surface of a tile. For example, an air blocking device may be at a 45 degree angle relative to the upper surface of tile 122*a*. Air block device 140 may be secured to tile 122*a* in any manner. In one embodiment, air blocking device 140 is attached by way of a bolts that pass through tile 122*a*. In certain embodiments, air blocking device 140 is secured by way of a bracket attached to tile 122*a*.

Figure 3:
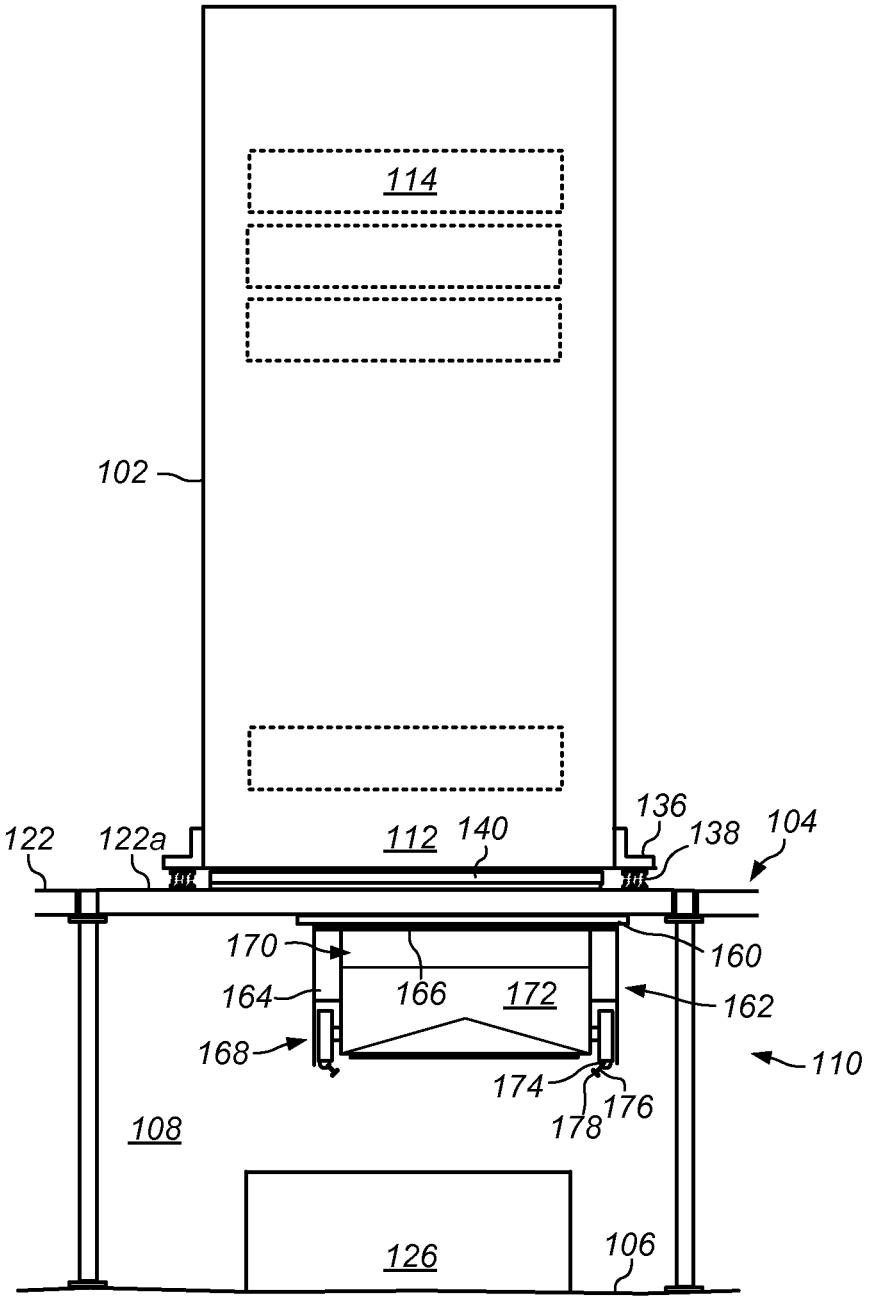
FIG. 3 is a front view of a data center with a fire suppression device mounted to the bottom of a tile of a raised floor.

FIG. 3 is a front view of a data center with a fire suppression device mounted to the bottom of a tile of a raised floor. Fire suppression device 110 includes mount 160 and reservoir assembly 162. In some embodiments, brackets are used to secure fire suppression device 110. Brackets may be attached by way of fasteners, such as bolts or screws. In certain embodiments, a mounting base for a fire suppression device is integral to a tile. In this case, a reservoir assembly may be fastened directly to the tile (for example, bolted to the tile).

Reservoir assembly 162 includes reservoir body 164, reservoir cover 166, and dispensing devices 168. Reservoir body 164 defines reservoir 170. Fire suppression material 172 is held in reservoir 170.

Each of dispensing devices 168 include dispensing device mount 174, thermal fuse 176, and spray tip 178. Dispensing devices 168 may overhang data center infrastructure component 126. Each of dispensing devices 168 may be in fluid communication with reservoir 170.

Thermal fuse 176 may trigger when the temperature at the location of the fuse reaches a predetermined temperature. In one embodiment, thermal fuse includes a material that melts at a predetermined temperature. Once a thermal fuse has been triggered for one of the dispensing devices 168, fire suppression material from reservoir 170 may be dispensed through spray tip 178 of that dispensing device.

In some embodiments, spray tip 178 may move as fire suppression material is dispensed from dispensing devices 168. In one embodiment, spray tip 178 rotates in a manner that distributes fire suppression material across surfaces of protected components. A dispensing device may rotate such that the spray direction pans from side of a protected component to the other side. In certain embodiments, a dispensing device oscillates back and forth from left to right.

Although dispensing devices 168 are shown as single point delivery elements, other types of dispensing devices may be used in various embodiments. For example, a dispensing device may be a perforated bar that spans across all or a portion of the width of one or more protected components.

In various embodiments, fire suppression material may be any suitable material that can be drawn from a reservoir, container, or vessel. Fire suppression material may be a liquid, a solid, or a gas, or a combination thereof. In certain embodiments, a fire suppression material is a powder.

In certain embodiments, a reservoir is pressurized such that fire suppression material is dispensed under pressure. For example, in certain embodiments, a carbon dioxide pressure system is coupled to reservoir 170 to promote delivery of fire suppression material 172 from reservoir 170.

In some embodiments, a dispensing device automatically changes the direction of a nozzle as the fire suppression material is dispensed. For example, initially, the nozzle of dispensing device 168 may be directed to spray on the left side of data center infrastructure component 126. As material is dispensed from dispensing device 168, dispensing device 168 may rotate such that spray tip 178 points progressively to the right side of electrical power supply component 126.

Figure 4:
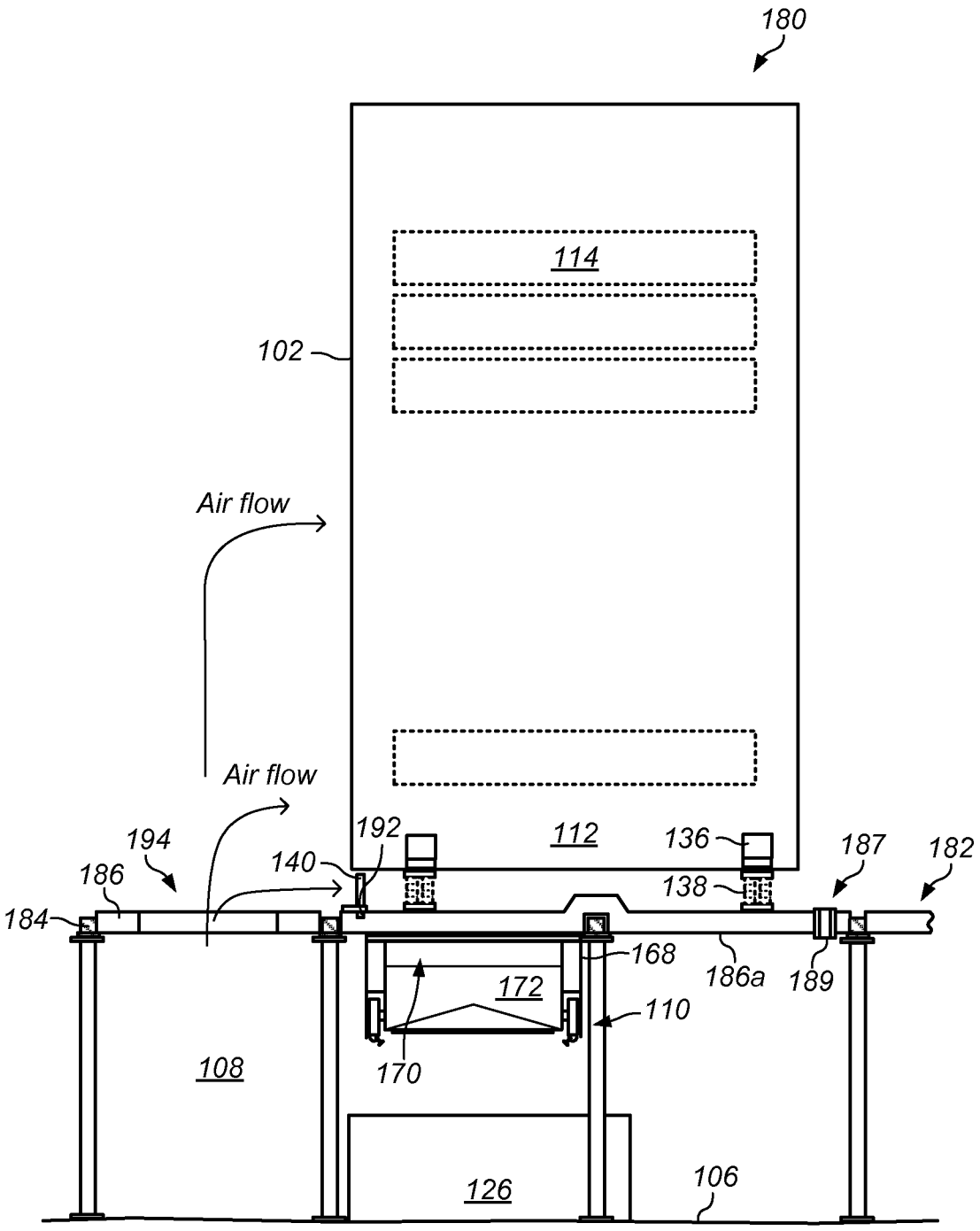
FIG. 4 is a side view of a data center with a fire suppression device mounted to the bottom of a tile of a raised floor.

FIG. 4 is a side view of a data center with a fire suppression device mounted to the bottom of a tile of a raised floor. Data center 180 includes raised floor 182, rack computing system 102, fire suppression device 110, and data center infrastructure component 126. Raised floor 182 includes grid 184 and tiles 186. Grid 184 may be a square grid. Raised floor 182 may be similar to that described above relative to FIGS. 1-3.

In some embodiments, a single tile is sized such that a rack can be installed on the tile. In the embodiment shown in FIG. 4, for example, tile 186*a* extends the full length of rack 112 and covers two adjacent openings in grid 184. Thus, for example, in a grid having 2 foot by 2 foot openings, tile 186*a* may be about 2 feet wide by 4 feet long. In certain embodiments, tiles supporting a rack may be connected to one another by a coupling element (for example, a bridge piece) between adjacent tiles.

Rack 112 is mounted on shock-mount devices 138 by way of brackets 136. Shock mount devices 138 may mitigate the effects of seismic loads on computing devices in rack 112. In one embodiment, shock mount devices 138 are lead rubber bearings. In certain embodiments, shock mount devices include spring elements that resist side-to-side motion (for example, swaying) of rack 112.

In some embodiments, shock mount devices for a rack include both spring devices and damping elements. A stabilization device may nevertheless in various embodiments include only spring devices (for example, with no damping elements), or only damping elements (for example, with no springs).

In certain embodiments, a rack-mounted fire suppression system serves as a stabilization device for a rack computing system. A fire suppression device mounted on a tile under a rack may serve act as ballast to reduce displacement of computing devices or other equipment in a rack mounted on a tile.

Air blocking device 140 is installed on tile 186*a*. Tile 186*a* includes groove 192. Groove 192 may run across a portion of tile 186*a*. To attach air blocking device 140 to tile 186*a*, groove 192 may receive a lip, protrusions, or similar elements on air blocking device 140.

Air from sub-floor space 108 may flow through vents 194 in tiles 186. Air blocking device 140 is attached to tile 122*a*. Air blocking device 140 may inhibit air from flowing under the enclosure of rack 112 and bypassing computing devices 114.

Tile 186*a* includes cable opening 187. Cable opening 187 may be sized to allow cables to pass through tile 186*a*. Grommet 189 is installed in cable opening 187. Grommet 189 may be made of a rubber or a polymeric material. Grommet 189 may protect cables from damage from contact with the sides of cable opening 187. In certain embodiments, grommet 189 is omitted.

In some embodiments, a mounting base for a fire suppression device includes shock mount devices. The shock mount devices may be as described above relative to FIGS. 1-3.

Figure 5:
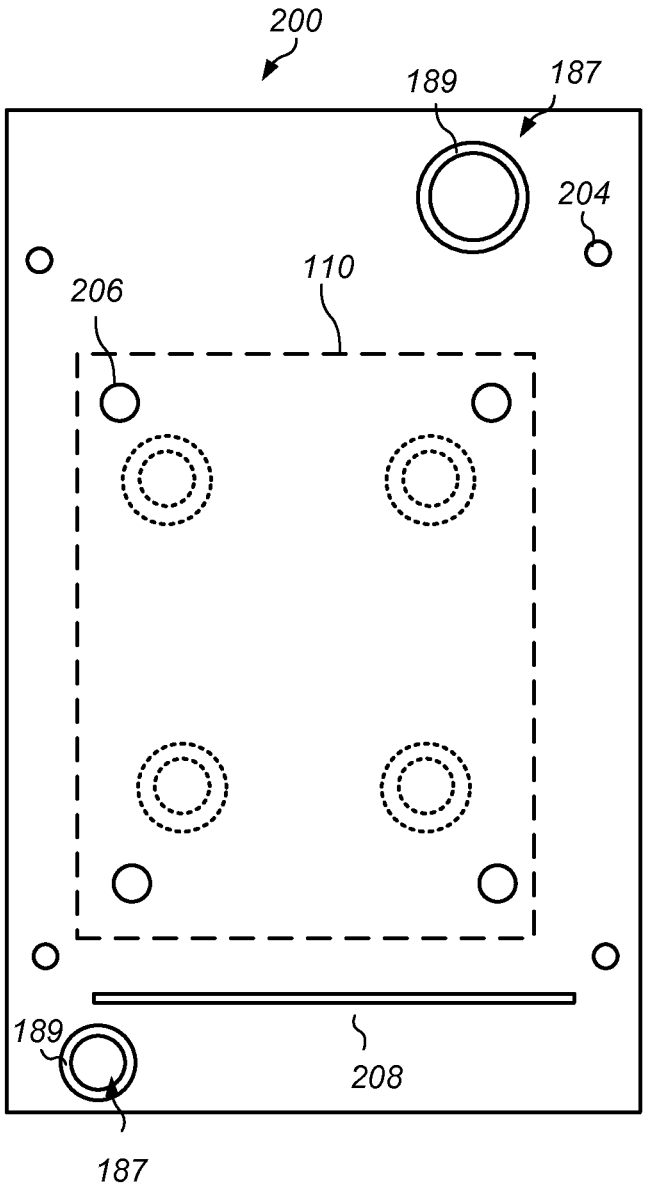
FIG. 5 is a top view of a fire suppression system including a raised floor tile and a fire suppression device.

FIG. 5 is a top view of a fire suppression system including a raised floor tile and a fire suppression device. Tile 200 includes tile body 202, rack mounting holes 204, fire suppression device mounting holes 206, groove 208, and cable opening 187.

Fire suppression device 110 may be coupled to tile body 202 by way of fasteners installed in fire suppression device mounting holes 206. A rack may be installed on tile body 202 by way of fasteners installed in rack mounting holes 204. In some embodiments, fire suppression device 110 is the full width and length of a tile (for example, 2 feet by 2 feet.)

Groove 208 may couple with an air blocking device, such as air blocking device 140 described above relative to FIG. 4. Cable opening 187 may allow for cables to pass through tile 200. A cable may be routed, for example, from a data infrastructure component below a raised floor to rack-mounted computing devices above a raised floor. Grommet 189 may protect cables from damage from contact with the walls of cable opening 187.

In certain embodiments, perforations in a tile may allow fluid to pass through tile 200. In some embodiments, perforations allow fire suppression material to migrate from above a tile to below a tile. In this case, fire suppression material from a computing room fire suppression system (for example, an overhead sprinkler system) may supplement fire suppression devices in a sub-floor space.

Figure 6:
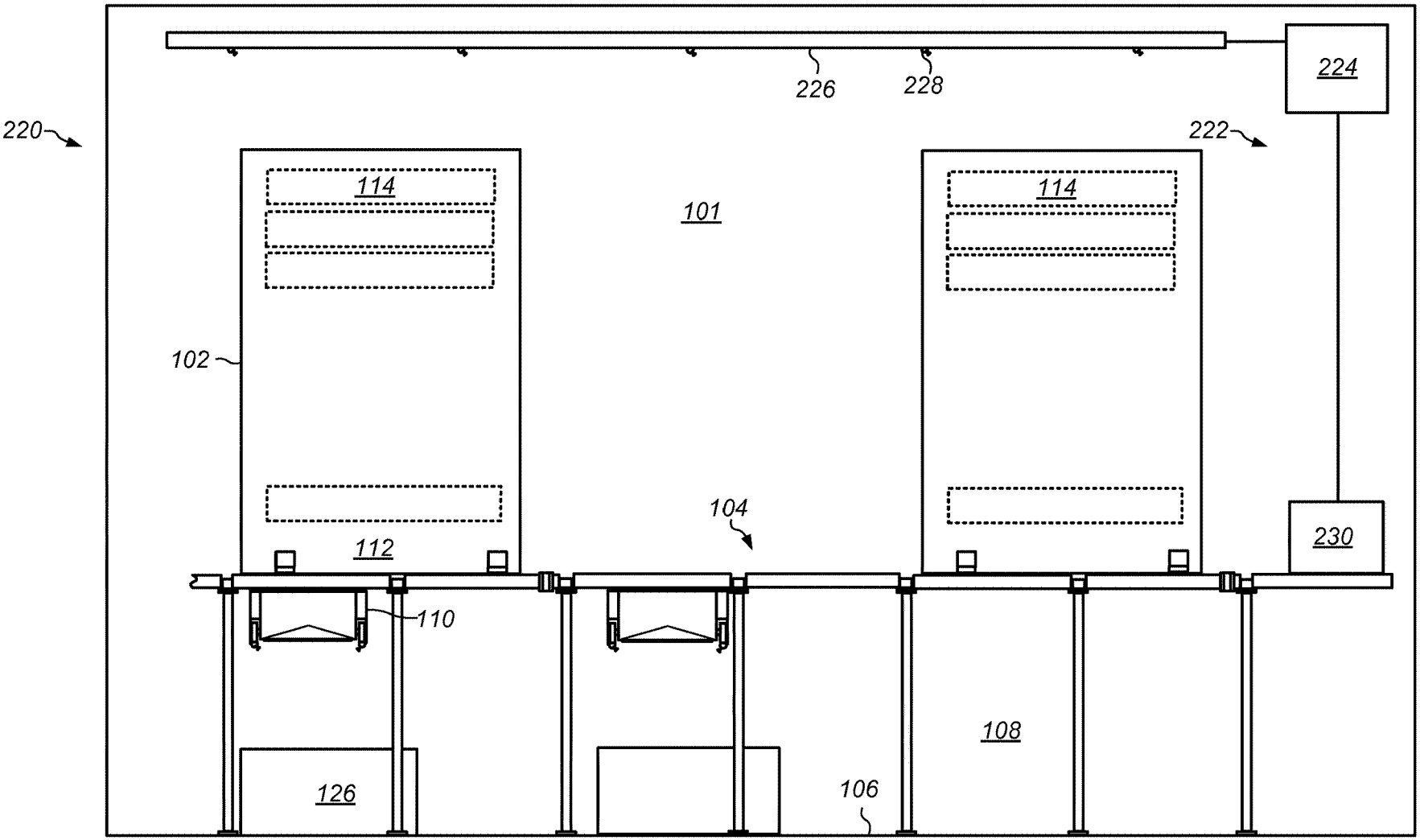
FIG. 6 illustrates a data center including an overhead computing room fire suppression system and sub-floor space fire suppression devices.

FIG. 6 illustrates a data center including an overhead computing room fire suppression system and sub-floor space fire suppression devices. Data center 220 includes computing room 101, rack computing systems 102, raised floor 104, and base floor 106. Sub-floor space 108 is formed between raised floor 104 and base floor 106. Fire suppression devices 110 are coupled under raised floor 104 in sub-floor space 108. Computing room fire suppression system 222 is installed in computing room 101.

Computing room fire suppression system 222 includes fire suppression material supply system 224, pipes 226, dispensing devices 228, and control system 230. Fire suppression material supply system 224 may deliver fire suppression material to dispensing devices 228 by way of pipes 226. Dispensing devices 228 may dispense fire suppression material on racks 112 and other elements in computing room 101 in response to a fire condition in computing room 101. Dispensing devices 228 may release fire suppression material in response to signals from fire suppression control system 230.

In one embodiment, fire suppression devices are mounted over each of two or more components in a sub-floor space. Fire suppression devices may be mounted directly under a rack or in other locations under a raised floor. For example, in the example shown in FIG. 6, one of fire suppression devices 110 is located on tiles under one of rack computing systems 102, and another of fire suppression devices 110 is mounted on a tile that is not under any of rack computing systems 102.

In the embodiment shown in FIG. 6, each of dispensing devices 168 may have its own thermal fuse. Nevertheless, in certain embodiments, two or more dispensing devices may be enabled by triggering of the same thermal fuse. A thermal fuse for a raised floor-mounted fire suppression system may be any suitable location. In one embodiment, a thermal fuse is mounted to the component to be protected (for example, one of data center infrastructure components 126).

In some embodiments, fire suppression system 222 operates independently of fire suppression devices 110. In addition, different fire suppression devices 110 attached to a raised floor may respond to fire conditions independently of one another. Thus, one or more of fire suppression devices 110 can be activated in response to a fire condition in sub-floor space 108 without requiring fire suppression system 222 to be activated. In certain embodiments, fire suppression devices 110 and fire suppression system 222 are commonly controlled by one control system (for example, by fire suppression control system 230.)

In certain embodiments, a fire suppression system is activated by a mechanism other than a thermal fuse. For example, in some embodiments, a fire suppression device is controlled using a control unit. The control unit may trigger the fire suppression device based on a temperature sensor, smoke detector, or other sensing device.

In certain embodiments, fire suppression systems for different parts of a sub-floor space may be coupled in fluid communication with one another. For example, reservoirs of fire suppression devices 110 may be connected by piping. Fluid coupling between reservoirs may augment a supply of fire suppression material that can be dispensed through one the dispensing devices in a particular protected component. In certain embodiments, a fluid link between reservoirs on different rack may be established by triggering of a thermal fuse.

Figure 7:
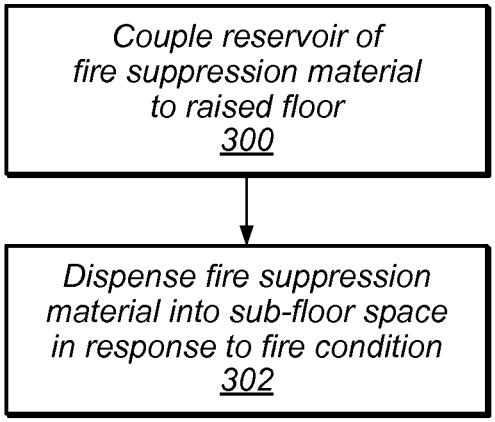
FIG. 7 illustrates one embodiment of suppressing fire in components in a sub-floor space.

In some embodiments, a method of suppressing fire includes coupling a reservoir of fire suppression material to a raised floor and dispensing fire suppression material in a space below the raised floor. FIG. 7 illustrates one embodiment of suppressing fire in components in a sub-floor space. At 300, a reservoir of fire suppression material is coupled to a raised floor. The raised floor may be, for example, a raised floor of a computing room.

In some embodiments, the reservoir is coupled to a tile of a raised floor. In some embodiments, a rack, a fire suppression device, or both are attached to a tile using fasteners in mounting holes in the tile. In certain embodiments, a tile is pre-drilled before the tile is delivered to the room in which it will be used. In other embodiments, holes for a tile a drilled on-site. Drilling holes on-site may allow for holes to be selected to a match a mounting pattern for a particular rack, or for a particular fire suppression device. In one embodiment, each of the data infrastructure components in the sub-floor of a data center may be provided with a fire suppression device. For example, a fire suppression device may be provided for each UPS, floor power distribution unit, or CRAC in a sub-floor space. In certain embodiments, fire suppression devices for different components are coupled one another.

At 302, fire suppression material is dispensed in a sub-floor space in response to a fire condition. Release of the fire suppression material may be triggered by a thermal fuse. The thermal fuse may be a block a material that melts at predetermined temperature. In certain embodiments, the release of fire suppression material may be activated or propelled by a charge. In certain embodiments, a fire suppression device is controlled by an external controller (for example, control system 230 described above relative to FIG. 6).

In some embodiments, a dispensing device may move to distribute fire suppression material to different portions of protected components. For example, a dispensing device may rotate such that a nozzle of the dispensing device pans from top to bottom of a protected component.

Although the embodiments above have been described in considerable detail, numerous variations and modifications will become apparent to those skilled in the art once the above disclosure is fully appreciated. It is intended that the following claims be interpreted to embrace all such variations and modifications.

What is claimed is:

1. A data center, comprising:

a raised floor comprising one or more frame members and a plurality of tiles coupled to the one or more frame members;

one or more rack computing systems coupled to at least one of the one or more the tiles;

a sub-floor space below the raised floor;

one or more data center infrastructure components in the sub-floor space configured to supply electrical power or cooling air to computing devices in at least one of the one or more rack computing systems; and one or more fire suppression devices mounted to at least one of the one or more tiles, wherein at least one of the one or more fire suppression devices includes a reservoir in the subfloor space and wherein the at least one of the one or more fire suppression devices is configured to dispense under pressure, from the reservoir, fire suppression material within the subfloor space to at least one of the one or more data center infrastructure components, wherein the reservoir is configured to be pressurized such that the fire suppression material is dispensed under pressure.

2. The data center of claim 1, wherein at least one of the rack computing systems and at least one of the fire suppression devices are commonly coupled to the same one of the tiles.

3. The data center of claim 1, wherein at least one of the one or more fire suppression devices is positioned to provide ballast to reduce displacement of at least one of the rack computing systems that is attached to a same tile as the at least one of the one or more fire suppression devices.

4. The data center of claim 1, further comprising an air blocking device coupled to at least one of the tiles, wherein the air blocking device is configured to inhibit air from flowing under a cabinet of at least one of the one or more rack computing systems.

5. The data center of claim 1, wherein the reservoir is configured to be pressurized by a pressure system that is coupled to the reservoir.

6. A system, comprising:

a raised floor configured to support one or more rack computing systems located above the raised floor;

a sub-floor space below the raised floor;

one or more electrical components in the sub-floor space; and one or more fire suppression devices coupled to the raised floor, wherein at least one of the one or more fire suppression devices includes a reservoir in the subfloor space and wherein the at least one of the one or more fire suppression devices is configured to dispense under pressure, from the reservoir, fire suppression material within the subfloor space to at least one of the one or more electrical components in the sub-floor space, wherein the reservoir is configured to be pressurized such that the fire suppression material is dispensed under pressure.

7. The system of claim 6, wherein the raised floor comprises one or more frame members and a plurality of tiles coupled to the one or more frame members, wherein at least one of the fire suppression devices is coupled to at least one of the one or more tiles.

8. The system of claim 7, further comprising one or more rack computing systems, wherein at least one of the rack computing systems and at least one of the fire suppression devices are commonly coupled to the same one of the tiles.

9. The system of claim 8, wherein at least one of the rack computing systems is coupled to the at least one tile by way of one or more spring devices.

10. The system of claim 8, further comprising one or more one or more electrical cables, wherein at least one of the tiles comprises an opening configured to allow at least one of the electrical cables to pass from the sub-floor space to at least one of the rack computing systems.

11. The system of claim 8, further comprising an air blocking device coupled to at least one of the one or more tiles, wherein the air blocking device is configured to inhibit air from flowing under a cabinet of at least one of the one or more rack computing systems.

12. The system of claim 6, wherein the reservoir is configured to hold fire suppression material.

13. The system of claim 6, further comprising a cooling air system, wherein the sub-floor space comprises a sub-floor plenum, wherein the cooling air system is configured to supply cooling air via the sub-floor plenum to space above the raised floor.

14. The system of claim 6, wherein at least one of the fire suppression devices is configured to dispense fire suppression material in response to one or more fire conditions.

15. The system of claim 6, further comprising:

a computing room above the raised floor; and a computing room fire suppression system comprising one or more computing room fire suppression devices, wherein the computing room fire suppression system is configured to dispense fire suppression material in the computing room, wherein at least one of the one or more fire suppression devices coupled to the raised floor operates independently of at least one of the computing room fire suppression devices.

16. The system of claim 6, further comprising:

a tile configured to mount in or on one or more frame members of the raised floor; and wherein at least one of the one or more fire suppression devices is coupled to the tile, wherein the at least one fire suppression device is configured to dispense fire suppression material into space under the tile when the tile is mounted in or on the one or more frame members.

17. The system of claim 16, wherein the tile comprises one or more holes, wherein the one or more holes are configured to mount one or more rack computing systems.

18. The system of claim 17, wherein the tile comprises one or more openings, wherein at least one of the one or more openings is configured to allow one or more electrical cables to pass from space under the tile to at least one of the rack computing systems.

19. The system of claim 16, wherein the tile comprises one or more vents configured to allow air to pass through the tile.

20. The system of claim 16, wherein the at least one fire suppression device is configured to dispense fire suppression material to one or more electrical power supply components in a space under the raised floor.

21. The system of claim 16, wherein the at least one fire suppression device is configured to dispense fire suppression material to one or more cooling system components in a space under the raised floor.

22. The system of claim 16, wherein the tile comprises a groove, wherein the groove is configured to couple with an air blocking device.

23. The system of claim 6, wherein the reservoir is configured to be pressurized by a pressure system that is coupled to the reservoir.

* * * * *